US006938565B2

(12) United States Patent
Geerts et al.

(10) Patent No.: US 6,938,565 B2
(45) Date of Patent: Sep. 6, 2005

(54) METHOD FOR INSERTING SYNTHETIC FIBERS INTO A SURFACE, AS WELL AS A DEVICE FOR CARRYING OUT THE SAME

(75) Inventors: Jan Frans Marie Geerts, Leest-Mechelen (BE); Josef Johannes Maria Van Son, Swalmen (NL)

(73) Assignee: Tapijtfabriek H. Desseaux N.V., Oss (NL)

( * ) Notice: Subject to any disclaimer, the term of this patent is extended or adjusted under 35 U.S.C. 154(b) by 206 days.

(21) Appl. No.: 10/257,396

(22) PCT Filed: Apr. 19, 2001

(86) PCT No.: PCT/NL01/00311

§ 371 (c)(1),
(2), (4) Date: Mar. 24, 2003

(87) PCT Pub. No.: WO01/79611

PCT Pub. Date: Oct. 25, 2001

(65) Prior Publication Data

US 2003/0172858 A1 Sep. 18, 2003

(30) Foreign Application Priority Data

Apr. 19, 2000 (NL) ..... 1014978

(51) Int. Cl.[7] ..... D05C 15/24
(52) U.S. Cl. ..... 112/80.57

(58) Field of Search ..... 112/475.08, 80.07, 112/80.08, 80.55, 80.56, 80.57, 80.7, 80.71; 242/554.2, 600, 118, 157 R; 83/24, 402, 436.3, 469, 937

(56) References Cited

U.S. PATENT DOCUMENTS

| | | | | |
|---|---|---|---|---|
| 3,595,185 A | * | 7/1971 | Shorrock et al. | 112/80.08 |
| 3,670,672 A | * | 6/1972 | Spanel et al. | 112/80.07 |
| 3,756,173 A | * | 9/1973 | Shorrock | 112/80.08 |
| 3,800,642 A | | 4/1974 | Hasler | |
| 3,937,158 A | | 2/1976 | Spanel | |
| 4,285,285 A | * | 8/1981 | Chambers et al. | 112/80.08 |
| 5,481,991 A | | 1/1996 | Geerts | |

* cited by examiner

*Primary Examiner*—Ismael Izaguirre
(74) *Attorney, Agent, or Firm*—Oblon, Spivak, McClelland, Maier & Neustadt, P.C.

(57) ABSTRACT

Method and device for inserting synthetic fibres into a surface, wherein a fibre is unwound from at least one roll. The fibre is transported through a tube to a position under an insertion element by an air flow and is subsequently cut off to a desired length. The fibre is then pressed into the surface by an inserting element. The fibre is cut off by a rotatable element which is rotatable about an axis, which rotatable element is provided with a passage which is co-axial with the tube in a first position of the rotatable element and which includes an angle with the tube in a second position of the rotatable element, in which position the fibre is cut off.

9 Claims, 7 Drawing Sheets

METHOD FOR INSERTING SYNTHETIC FIBERS INTO A SURFACE, AS WELL AS A DEVICE FOR CARRYING OUT THE SAME

BACKGROUND OF THE INVENTION (1) Field of the Invention

The invention relates to a method for inserting synthetic fibres into a surface, wherein a fibre is unwound from at least one roll, said fibre is transported through a tube to a position under an insertion element by means of an air flow, after which the fibre is cut off to a desired length, whereupon the fibre is pressed into the surface by means of an insertion element.

The invention furthermore relates to a device which is suitable for carrying out such a method.

(2) Description of Related Art

In a device of this kind, which is known from U.S. Pat. No. 3,937,158, a fibre which has been unwound from a roll is passed through a tube and positioned a desired length beyond the insertion element by means of specific guiding and clamping devices.

Each tube of the known device comprises at least two tube members which are movable relative to each other, wherein a knife can be moved between the tube members when said tube members are being moved apart. The fibre that extends through the tube is cut off by means of said knife. One drawback of such a method for cutting off fibres is that there is a risk of a fibre end getting wedged between the two tube members when said tube members are moved back towards each other, as a result of which further transport of the fibre is no longer possible. Furthermore there is a possibility of dirt finding its way into the tube members when the tube members are spaced apart. Furthermore there is a risk of operating staff injuring themselves on the knife in this position of the tube members.

BRIEF SUMMARY OF THE INVENTION

The object of the invention is to provide a method and a device wherein the fibre can be cut off in a simple manner.

This objective is accomplished with the method according to the invention in that the fibre is cut off by means of an element which is rotatable about an axis, which element is provided with a passage which is co-axial with the tube in a first position of the rotatable element and which includes an angle with the tube in a second position of said rotatable element, in which position the fibre is cut off.

Rotation of the element causes the fibre to be cut off by the edge of the passage and the edge of the tube. When the element is returned to the original position, an uninterrupted passage through the tube is obtained again. Thus a correct guidance of the fibre is ensured. As a result of the presence of the tube and the rotatable element, a substantially completely closed system is obtained, wherein substantially no dirt can penetrate and wherein the risk being injured upon cutting of the fibre is excluded.

Preferably, the diameter of the tube member on one side of the rotatable element is larger than that of the tube member on the other side of the rotatable element. This makes it possible to ensure that the fibre is only cut off near the transition between the element and the tube member having the smaller diameter, whilst the fibre is not cut off near the transition between the tube member having the larger diameter and the element.

One embodiment of the method according to the invention is characterized in that the device furthermore comprises a guide tube which is co-axial with the tube, which guide tube is positioned on a side of the tube remote from the insertion element and which is axially movable with respect to the tube from a first position, in which a substantially uninterrupted passage between the tubes is provided, to a second position, in which a passage for the insertion element is provided.

The presence of the movable guide tube likewise ensures a correct guidance of the fibre.

Such guidance is in particular important when the fibre is transported by means of an air flow, since the absence of an effective guidance might lead to uncontrolled fibre movement under the influence of the air flow.

The air flow ensures that the fibre remains elongate and clear of the walls of, for example, a tube. This enables easy transport of the fibre, without there being a need to take hold of the end of the fibre.

As soon as the fibre extends sufficiently far beyond the insertion element, the fibre is cut off and pressed into the surface.

Another embodiment of a method according to the invention is characterized in that the fibre is passed through a venturi device, wherein the air flow that carries the fibre is generated in the venturi device.

The venturi device makes it possible to generate a desired air flow in an efficient manner.

Another object of the invention is to provide a device by means of which fibres can be processed in a more efficient manner.

This objective is accomplished with the device according to the invention in that the device comprises a fibre clamping and cutting device, which comprises an element which is rotatable about a central axis, which element is provided with a passage which is co-axial with the tube in a first position of the rotatable element and which includes an angle with the tube in a second position of said element.

The fibre can be cut off in a relatively simple manner by means of the rotatable element.

BRIEF DESCRIPTION OF THE DRAWINGS

The invention will now be explained in more detail with reference to the drawings, wherein.

DETAILED DESCRIPTION OF THE INVENTION

Parts corresponding to each other are indicated by the same numerals in the figures.

Figure 1A:
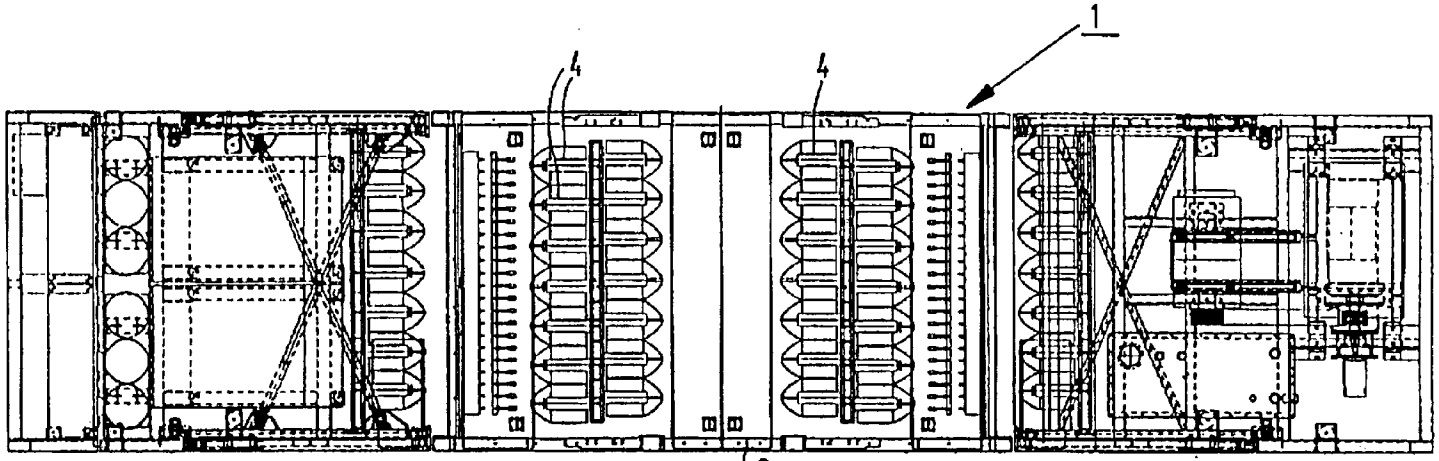
FIGS. 1A and 1B are a top plan view and a side elevation, respectively, of one embodiment of a device according to the invention.
Figure 1B:
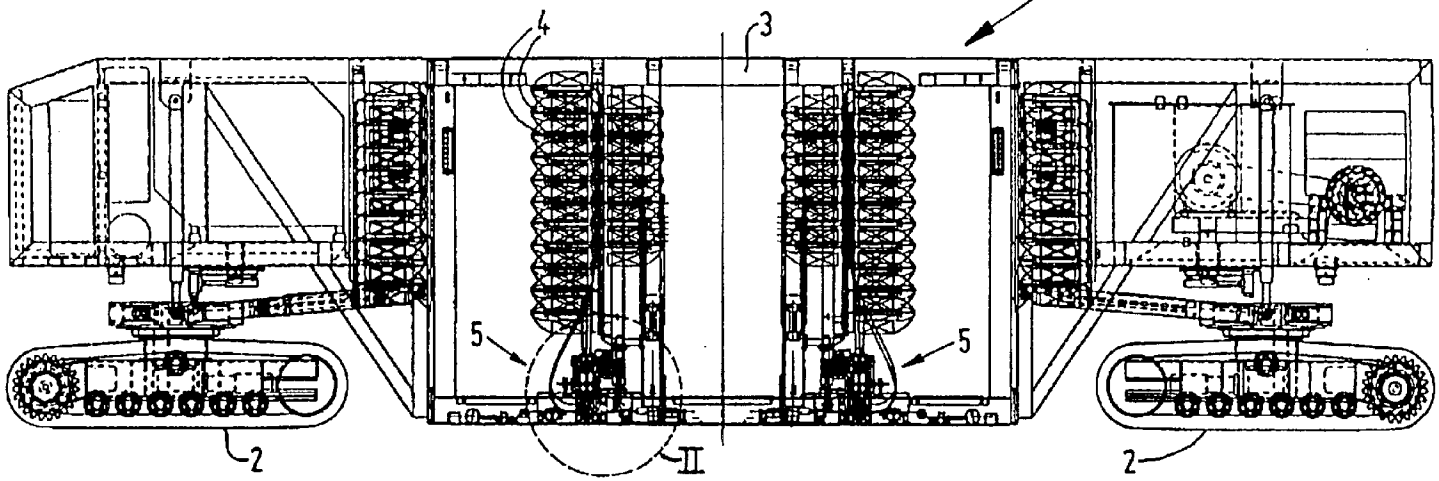

FIGS. 1A and 1B are a top plan view and a side elevation, respectively, of a device 1 according to the invention, which comprises a frame 3 supported by caterpillar tracks 2. Frame 2 rotatably supports a number of rolls 4, on which fibres are wound. Associated with each roll 4 is a fibre insertion device 5, which will be explained in more detail with reference to FIG. 2. The fibre insertion devices 5 are arranged in side-by-side relationship in two parallel rows, so that two rows of fibres can be simultaneously inserted into the surface with each go.

Figure 2:
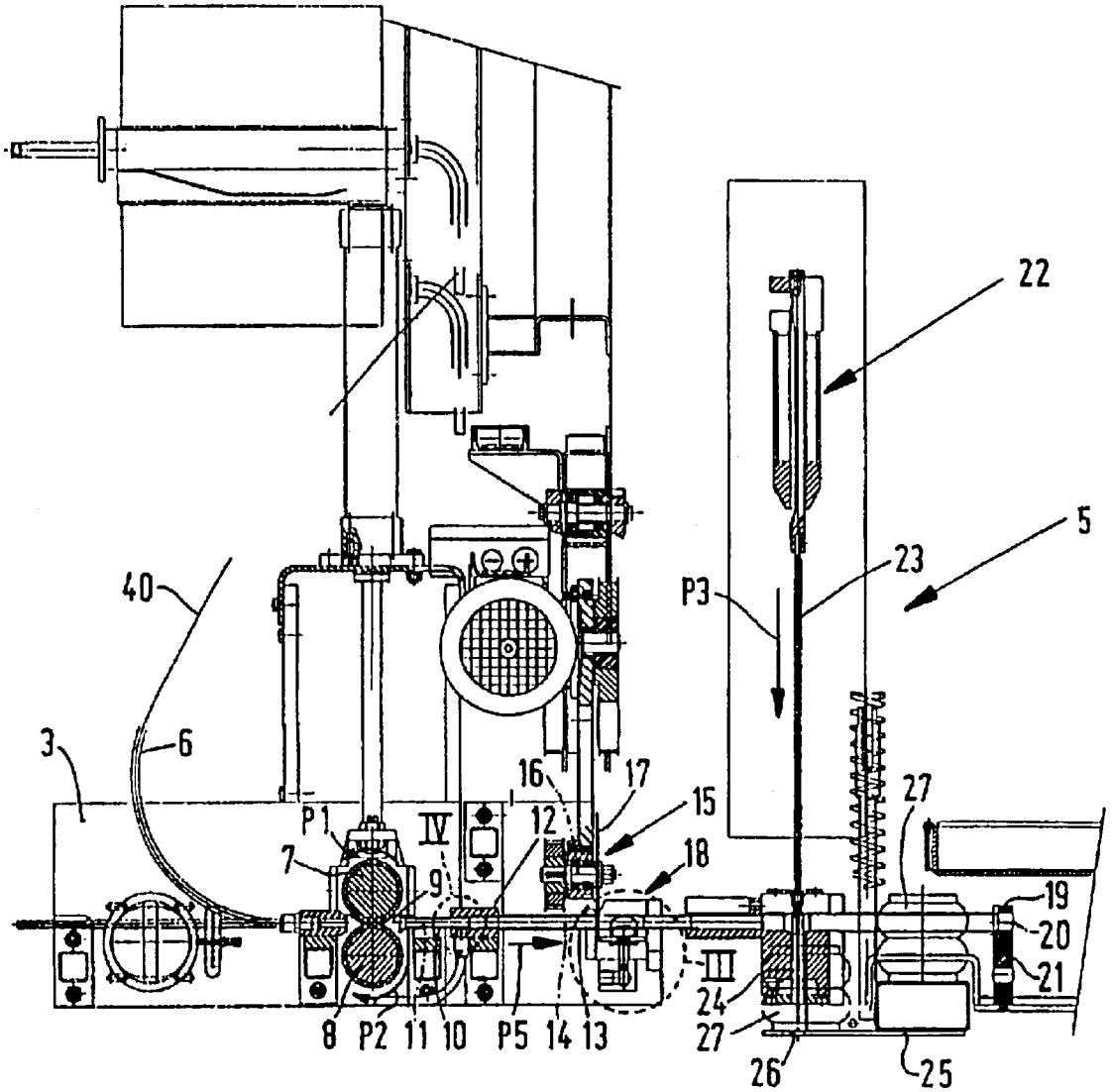
FIG. 2 is a larger-scale view of the portion II of the side elevation of FIG. 1B, which shows a fibre cutting device comprising a knife.

FIG. 2 is a larger-scale view of the portion II of the side elevation of FIG. 1B, wherein a single fibre insertion device 5 is shown. Each fibre insertion device 5 comprises a fibre feed-through tube 6 connected to roll 4, which tube opens, on a side remote from roll 4, into a feed-through plane 9 between two opposed wheels 7, 8. Wheels 7, 8 are rotatable in opposed directions as indicated by arrows P1, P2. A tube 10 is disposed opposite wheels 7, 8, on a side remote from feed-through tube 6. The central axis 11 of tube 10 lies in feed-through plane 9. One end of tube 10 remote from wheels 7, 8 opens into a venturi device 12, which will be explained in more detail with reference to FIG. 4. A tube 13, whose central axis 14 coincides with the central axis 11 of tube 10, extends from the venturi device 12. A fibre cutting device 15, which comprises a knife 17 which is rotatable about a central axis 16, is provided on a side of tube 13 remote from the venturi device 12. Disposed on a side of knife 17 remote from tube 13 is a fibre clamping device 18, which will be explained in more detail with reference to FIG. 3. At a location beyond fibre clamping device 18, fibre insertion device 5 includes a fibre feed-through channel 19, whose central axis 20 coincides with axes 11 and 14. Fibre feed-through channel 19 terminates in an end plate 21. Disposed between fibre clamping device 18 and end plate 21 is a fibre insertion device 22, which comprises a fibre insertion pin 23, which extends transversely to central axes 11, 14, 20. Disposed under fibre insertion pin 23 are the fibre feed-through channel 19, a guide channel 24 disposed thereunder and an opening 26 in a press-down plate 25. Fibre insertion pin 23 and press-down plate 25 can be moved independently of each other in a direction indicated by arrow P3 and in a direction opposite thereto by means of bellows 27, which can be actuated by means of compressed air. Before explaining the operation of the device 5 that is shown in FIG. 2, the fibre clamping device 18 and the venturi device 12 that are shown in FIGS. 3 and 4 will first be described in more detail.

Figure 3:
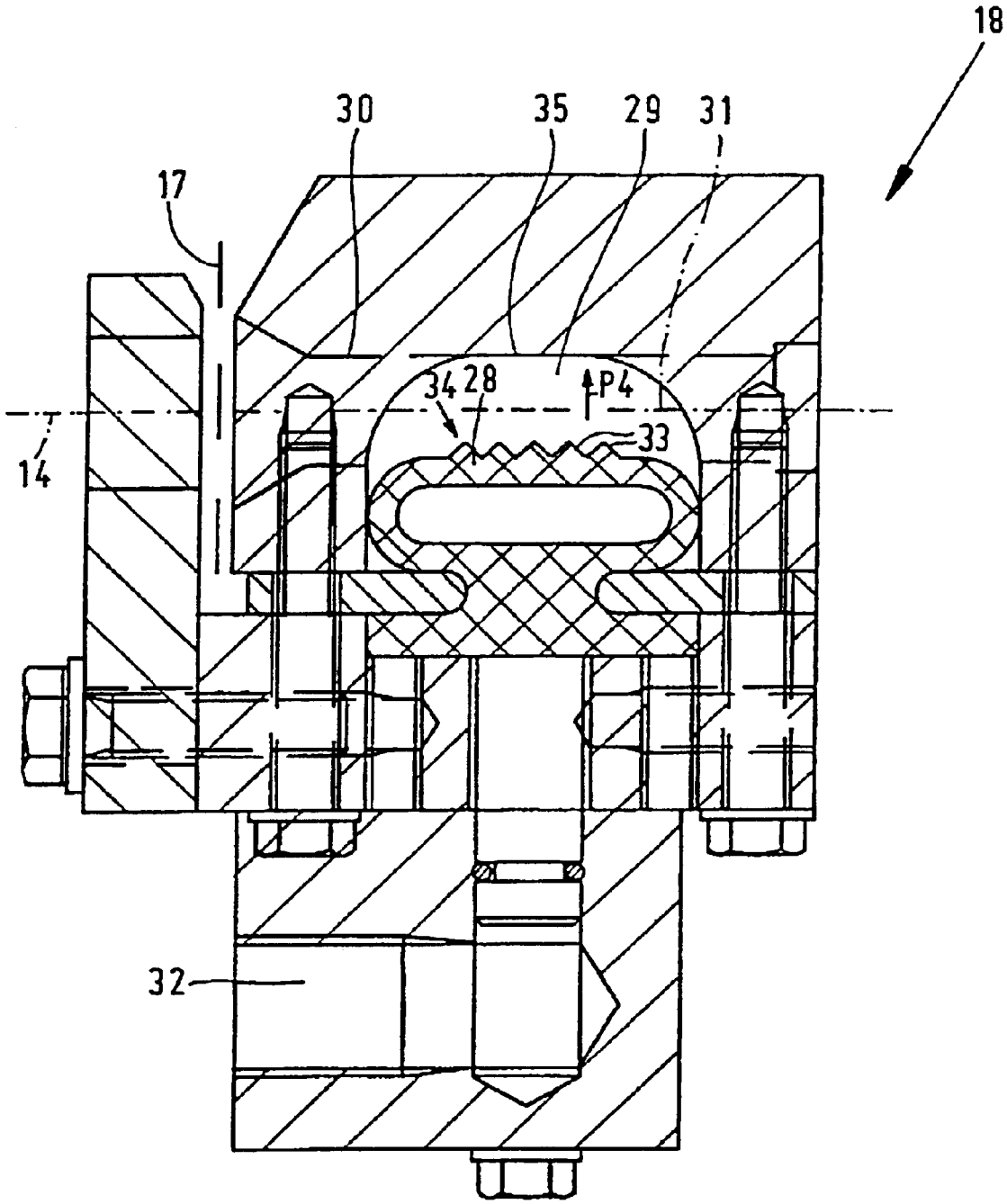
FIG. 3 is a larger-scale view of the portion III of the side elevation of FIG. 2.

FIG. 3 shows a clamping device 18, which includes a bellows 28 made of an elastically deformable material, such as rubber, which is disposed in a chamber 29. A feed-through channel 30, whose central axis coincides with axes 11, 14, 20, extends through chamber 29. Bellows 28 is connected to an air supply channel 32 at a bottom side remote from chamber 29. By supplying air to bellows 28 via air supply channel 32, the toothed (33) surface 34 of bellows 28 that faces towards chamber 29 is moved in the direction indicated by arrow P4 towards the wall 35 of feed-through channel 30. If a fibre extends through feed-through channel 30, said fibre is pressed against the wall 35 of feed-through channel 30 by surface 34. When subsequently surface 34 is moved in a direction opposed to the direction indicated by arrow P4, the fibre will be released again. As is shown in FIG. 3, a gap is present to the left of feed-through channel 30, into which gap the knife 17 can be moved.

Figure 4:
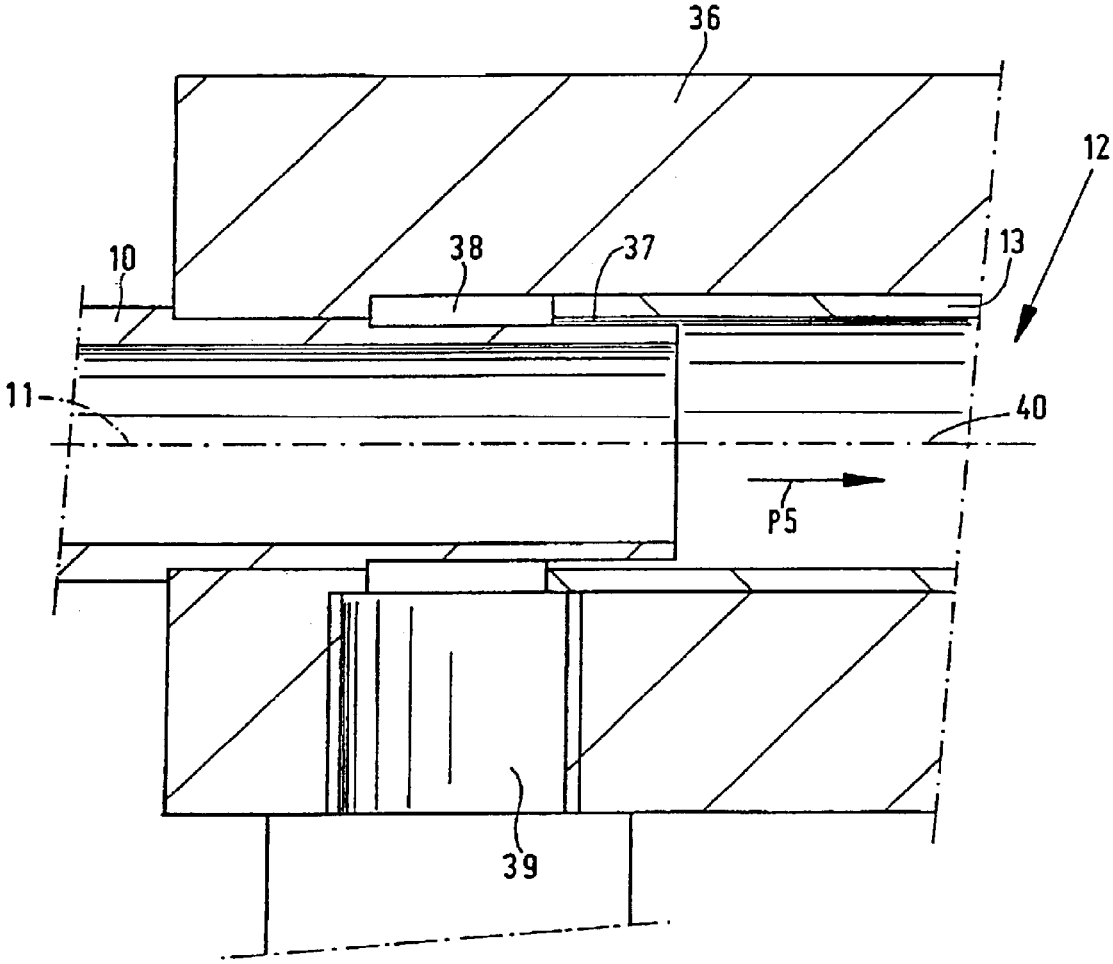
FIG. 4 is a larger-scale view of the portion IV of the side elevation of FIG. 2.

FIG. 4 shows the venturi device 12 according to the invention, which comprises a holder 36, which accommodates ends of tubes 10 and 13. The end of tube 10 extends partially into the end of tube 13. An annular gap 37 is present between tube 10 and tube 13. Said annular gap 37 opens into an annular air supply chamber 38 on a side that faces towards tube 10. Air supply chamber 38 is further connected to an air supply channel 39. Annular gap 37 opens into tube 13 on a side remote from air supply chamber 38. Compressed air that is being supplied from air supply line 39 is forced through annular gap 37 via annular chamber 38. As soon as the air exits annular gap 37, the air in tube 13 will expand, thus exerting a force in the direction indicated by arrow P5 on the fibre 40 that is present in tube 13, as a result of which fibre 40 will be moved in the direction indicated by arrow P5.

The overall process of inserting a fibre into a surface will now be explained with reference to FIGS. 1–4.

Frame 3 is moved across a surface that is to be provided with synthetic fibres by means of caterpillar tracks 2. During said movement, a fibre 40 is unwound from each roll 4, which fibre is moved between the wheels 7, 8, which rotate in opposed directions, via feed-through tube 6. Wheels 7, 8 pull fibre 40 from roll 4. Fibre 40 is introduced into tube 11 on a side remote from feed-through channel 6 and guided into the venturi device 12. In the venturi device 12, the air that is supplied via air supply channel 39 exerts a propelling force on fibre 40 in the direction indicated by arrow P5, as a result of which fibre 40 is guided further in the direction indicated by arrow P5. Once rolls 7, 8 have made a desired number of revolutions, the front end of fibre 40 will be positioned near end plate 21. Then the fibre 40 is pressed against surface 35 of feed-through channel 30 in the above-described manner by means of fibre clamping device 18. Following that, fibre 40 is cut off by means of knife 17 of fibre cutting device 15.

After fibre 40 has been cut off by means of knife 17 of the cutting device 15, the clamping action that is being exerted on fibre 40 by means of clamping device 18 is released, after which the fibre 40 will be loose in feed-through channel 19. Then the pin 23 of fibre insertion device 22 is moved in the direction indicated by arrow P3, whereby pin 23 presses fibre 40 into the feed-through channel 24 and through opening 26. Then the fibre is pressed further into the surface that is present under plate 25 by means of pin 23. Once pin 23 has been pressed the desired distance into the surface, pin 23 is moved in the direction opposed to the direction indicated by arrow P3. In order to prevent the surface being moved in this direction as well, press-down plate 25 is likewise moved in the direction indicated by arrow P3 by means of bellows 27 when pin 23 is being moved in said direction, and caused to press down on said surface. Only when pin 23 has been removed from the surface is plate 25 moved, likewise in the direction opposed to the direction indicated by arrow P3. Fibre 40 is now disposed in said surface and device 1 can be moved a desired distance by means of caterpillar tracks 2. While device 1 is being moved, a fibre 40 is unwound from roll 40 again by means of rollers 7, 8, and positioned under insertion pin 23 in the above-described manner, after which a next fibre 40 can be pressed into the surface. In this manner it is possible to insert a fibre having a length of 43 cm, for example, 20 cm deep into a surface every three seconds, as a result of which the two fibre ends will each project 1.5 cm above the surface. The insertion of the fibres into the surface, which further comprises grass, for example, strengthens the turf. When the grass is cut to a length of at least 2 cm, the synthetic fibres that are present therein will not form an impediment when the grass is being mown.

It is possible to move the fibre insertion device 22 towards or away from fibre cutting device 15. This makes it possible to cut the fibre to any desired length, depending on the depth to which the fibre is to be inserted into the surface.

Figure 5:
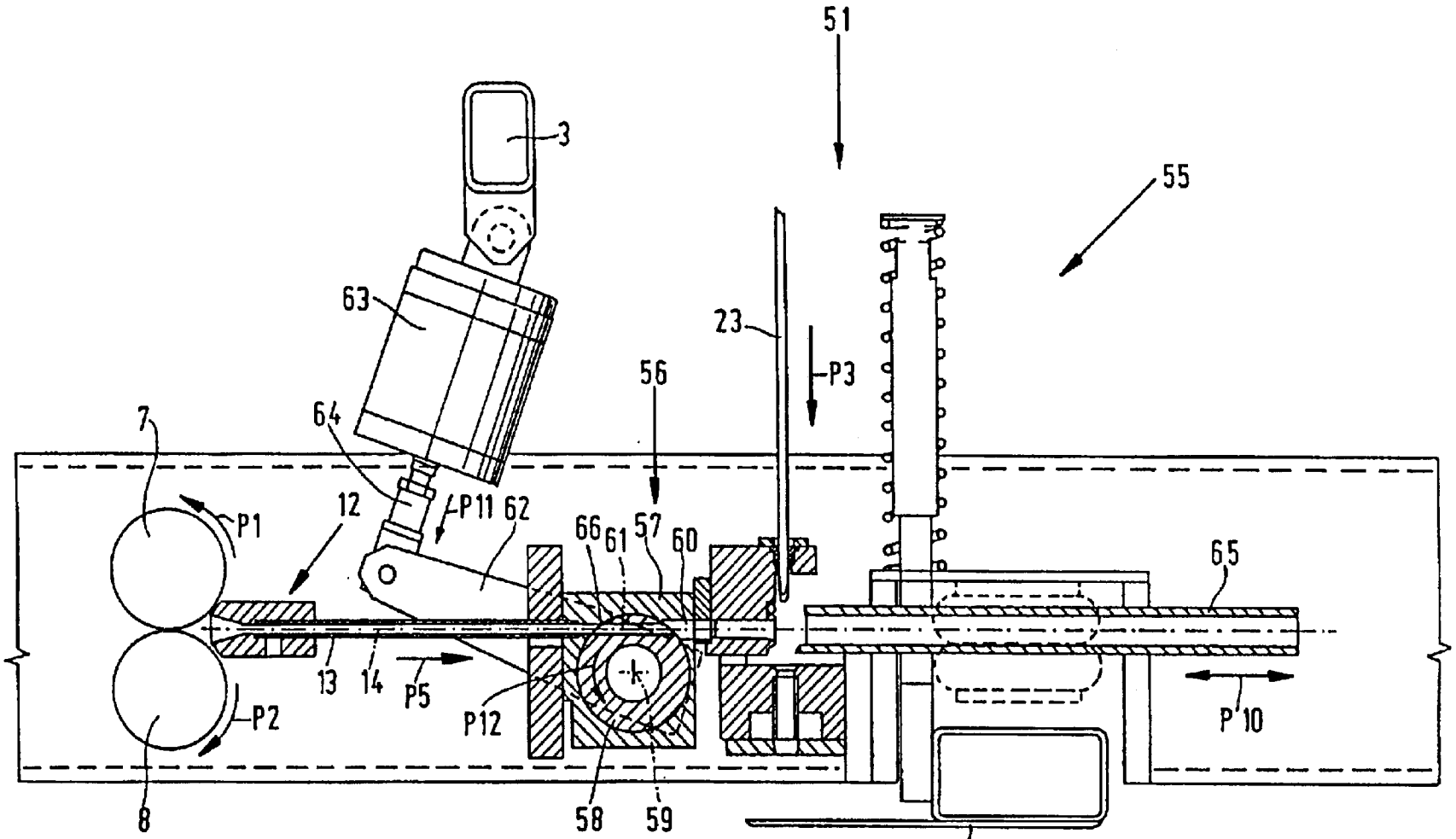
FIG. 5 is a larger-scale view of the portion of the side elevation of FIG. 1B of one embodiment of a device comprising a cutting device according to the invention.

FIG. 5 shows an embodiment of a device 51 according to the invention, which comprises a fibre insertion device 55, which differs from the fibre insertion device 5 of FIGS. 1–4 on a number of points.

Fibre insertion device 55 comprises a fibre clamping and cutting device 56, which includes a stationary block 57 and a bar 58 which is rotatably supported therein. A passage 60 is formed through block 57 and bar 58 in a direction transversely to central axis 59, the central axis 61 of which coincides with central axis 14. Bar 58 is connected, via an arm 62, to one end of a rod 64 which is movable in a pneumatic cylinder 63. Cylinder 63 is pivotally connected to frame 3 on a side remote from arm 62. Fibre insertion device 55 furthermore includes a guide tube 65, which is disposed on a side of the fibre insertion pin 23 remote from device 56. Guide tube 65 is reciprocable in the directions indicated by double arrow P10, from a first position, in which an uninterrupted passage is provided through tube 13 and tube 65, to a second position as shown in FIG. 5, in which a passage is clear for fibre insertion pin 23.

The operation of the fibre insertion device 55 is as follows. A fibre is introduced into tube 13 by means of rollers 7, 8 and venturi device 12 in a similar manner as with fibre insertion device 5, and carried onwards to a position near the end of tube 65. Tube 65 occupies said first position thereby. Then the pneumatic cylinder 63 is energized, as a result of which rod 64 is moved in the direction indicated by arrow P11. The movement of rod 64 causes arm 62 and the bar 56 connected thereto to pivot about central axis 59 in the direction indicated by arrow P12. This pivoting movement brings an edge 66 of passage 60 in bar 58 into contact with the fibre, as a result of which the fibre is at the same time clamped down and cut off upon further pivoting of bar 58.

Then bar 58 is pivoted in the direction indicated by arrow P12 by moving rod 64 in a direction opposed to the direction indicated by arrow P11, until the passage 60 in bar 58 extends parallel to central axis 14.

After the fibre has been cut off, tube 65 is moved to a second position, after which fibre insertion pin 23 is moved in the direction indicated by arrow P3 and the fibre is inserted into the surface.

Figure 6:
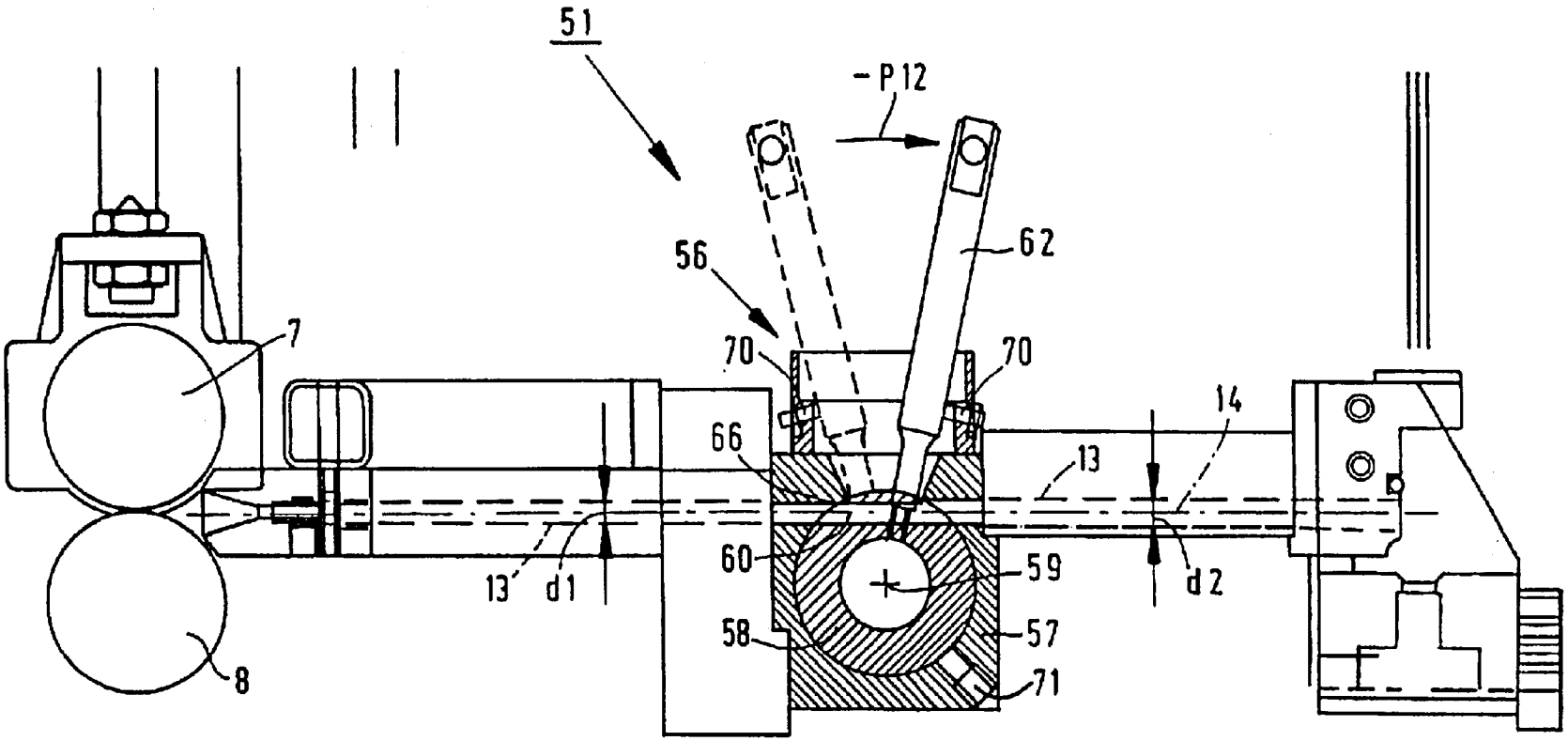
FIGS. 6 and 7 are side elevations of a second embodiment of a device according to the invention.
Figure 7:
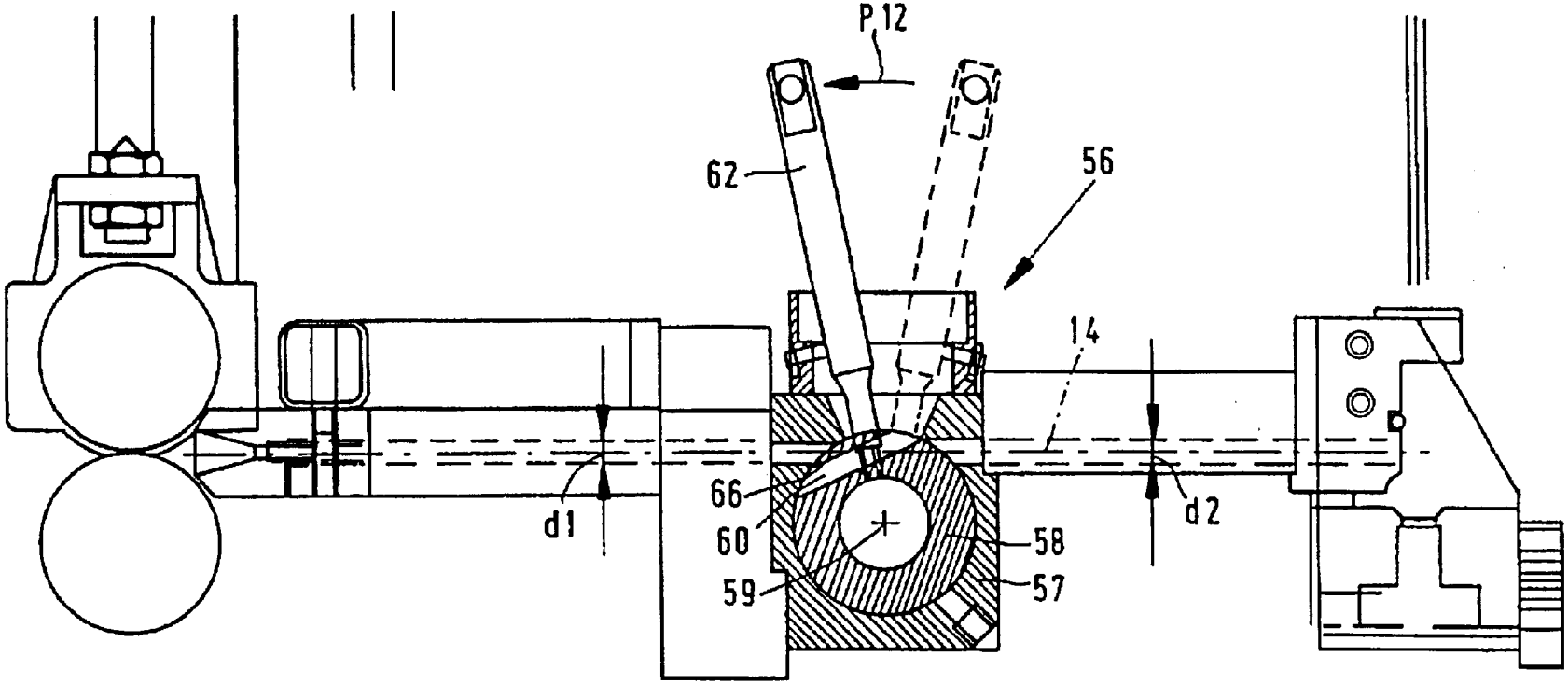

FIGS. 6 and 7 show a second embodiment of a fibre clamping and cutting device 56, wherein arm 62 is pivotable between two stops 70. The bar 58 comprising the passage 60 is thereby moved from the first position, in which passage 60 is co-axial with tube 13, to a second position, in which passage 60 includes an angle with tube 13. In this latter position the fibre is clamped down and simultaneously cut off. In order to ensure that the fibre can only be cut off near the left-hand side of passage 60, seen in FIGS. 6 and 7, the diameter d1 of tube 13 near the left-hand side is smaller than the diameter d2 near the right-hand side.

In order to ensure a proper cutting action between the edges of bar 58 and tube 13, cutting device 56 is fitted with a plastic cap 71, by means of which bar 58 is firmly pressed down on block 57 in radial direction, so that it will abut firmly against block 57 near cutting edge 66.

Bar 58 remains rotatable about central axis 59 thereby.

What is claimed is:

1. A method for inserting synthetic fibres into a surface, comprising:

unwinding a fibre from a roll;

transporting the fibre through a first tube to a position under an insertion element by an air flow;

after the transporting, cutting the fibre off to a desired length, whereupon the fibre is pressed into the surface by an insertion device, wherein the fibre is cut off by a rotatable element that is rotatable about an axis, which rotatable element is provided with a passage that is co-axial with the first tube in a first position of the rotatable element and that includes an angle with the first tube in a second position of the rotatable element, in which position the fibre is cut off.

2. A method according to claim 1, wherein the insertion element further includes a guide tube that is co-axial with the first tube, which guide tube is positioned on a side of the first tube remote from the insertion element and which is axially movable with respect to the first tube from a first position, in which a substantially uninterrupted passage between the guide tube and the first tube is provided, to a second position, in which a passage for the insertion element is provided.

3. A method according to claim 1, wherein in the transporting the fibre is passed through a venturi device, and wherein the air flow that carries the fibre is generated in the venturi device.

4. A device configured to carry out the method according to claim 1, which device comprises:

at least one roll on which the fibre is wound;

an unwinding device for unwinding the fibre from the at least one roll;

a fibre feed-through device including the first tube;

a fibre cutting device;

the insertion element; and the venturi device for transporting the fibre from the unwinding device by an air flow, wherein the fibre cutting device includes a fibre clamping and cutting device including the rotatable element that is rotatable about the axis, which rotatable element is provided with the passage that is co-axial with the first tube in the first position of the rotatable element and that includes the angle with the first tube in the second position of the rotatable element.

5. A device according to claim 4, further comprising a guide tube that is co-axial with the first tube, which guide tube is positioned on a side of the first tube remote from the insertion element and that is axially movable with respect to the first tube from a first position, in which a substantially uninterrupted passage between the first tube and the guide tube is provided, to a second position, in which a passage for the insertion element is provided.

6. A device according to claim 4, wherein the fibre feed-through device includes two opposed wheels that are rotatable in opposed directions, which wheels are in contact with each other in a feed-through plane, while the venturi device includes an elongate tube, one end of which is positioned opposite the two wheels in the feed-through plane.

7. A device according to claim 6, wherein one end of the first tube remote from the two wheels is positioned in a further tube, wherein an annular air supply opening is present between the first tube and the further tube.

8. A device according to claim 4, further comprising a fibre clamping device positioned between the fibre cutting device and the insertion element.

9. A device according to claim 8, wherein the fibre clamping device includes an air-actuated bellow.

* * * * *